United States Patent [19]

Carlsson et al.

[11] 4,301,927

[45] Nov. 24, 1981

[54] PACKING CONTAINERS WITH POURING SPOUT

[75] Inventors: Lars C. Carlsson, Blentarp; Johan H. H. Selberg, Lund, both of Sweden

[73] Assignee: Tetra Pak International AB, Lund, Sweden

[21] Appl. No.: 144,861

[22] Filed: Apr. 29, 1980

[30] Foreign Application Priority Data

May 8, 1979 [SE] Sweden ..... 7904000
Sep. 18, 1979 [SE] Sweden ..... 7907719

[51] Int. Cl.[3] ..... B65D 5/74

[52] U.S. Cl. ..... 206/622; 229/7 R; 229/17 R

[58] Field of Search ..... 206/622, 604, 620; 220/266; 229/7 R, 17 R

[56] References Cited

U.S. PATENT DOCUMENTS

| | | | |
|---|---|---|---|
| 2,156,366 | 5/1939 | Volk | 229/17 R |
| 2,554,050 | 5/1951 | Neuheck | 229/17 R |
| 3,318,505 | 5/1967 | Garrison | 229/7 R |
| 3,412,918 | 11/1968 | Shuman | 229/7 R |
| 3,791,570 | 2/1974 | Hopkins | 206/604 |
| 3,795,359 | 3/1974 | Rausing | 206/622 |

FOREIGN PATENT DOCUMENTS

| | | | |
|---|---|---|---|
| 940485 | 10/1963 | United Kingdom | 229/17 R |

*Primary Examiner*—Herbert F. Ross
*Attorney, Agent, or Firm*—Burns, Doane, Swecker & Mathis

[57] ABSTRACT

Packing containers of the non-returnable type for the packaging of milk, etc, frequently have a fold-out pouring spout which is intended to facilitate the pouring out of the milk in a concentrated jet.

However, the air which must enter the package via the pouring spout at the same time as the pouring out takes place causes the flow to stop periodically so that the pouring out occurs jerkily.

This disadvantage is overcome in accordance with the invention in that the spout is designed to have an emptying duct as well as an air duct. The air duct extends into the packing container over such a length that air can pass unhindered into the packing container without disturbing the flow of the contents through the pouring spout.

18 Claims, 4 Drawing Figures

PACKING CONTAINERS WITH POURING SPOUT

Figure 1:
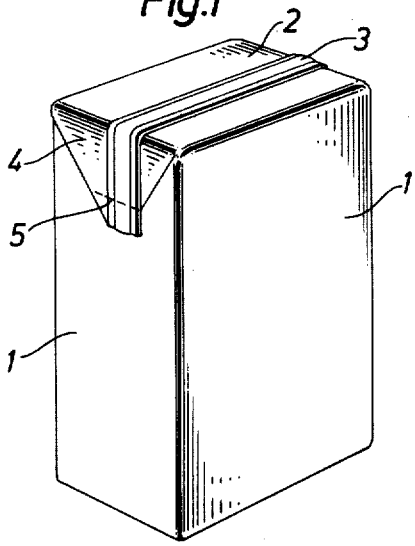

The present invention relates to a packing container of the non-returnable type comprising a container body made up of a flexible packing laminate with an integral part forming a pouring spout, the outer end of which is separable.

Packing containers of the non-returnable type for the packaging of e.g. milk are usually made of a flexible laminate material which comprises a carrier layer of paper which is coated on both sides with thin layers of liquidtight heat-sealable plastic material, e.g. polyethylene. In the manufacture of the packing containers the packing material is converted first to tubular shape by sealing together its longitudinal edges in a liquidtight manner. Then the tube is filled with contents and sealed in sealing zones extending transversely across the tube by pressing it together at uniform intervals with the help of heated sealing jaws arranged transversely in relation to the tube, so that the heat-sealable plastic layers situated on the inside of the tube join together the tube sides in liquidtight, transverse seals. By a simultaneous forming process the filled containers are given a final, substantially parallelepipedic shape, and the containers are separated from each other by cuts through the sealing zones and the sealing fins formed are folded down to lie against adjoining packing container walls. During the forming process four double-walled corner lugs are also produced, which are formed from material which for geometrical reasons cannot be utilized in the formation of the actual parallelepipedic container body. In order to keep them out of the way, and so as not to disturb the regular parallelepipedic shape, these flattened corner lugs are folded in against adjoining packing container surfaces. After this the packing container is ready.

In the same manner packing containers of different shapes, e.g. tetrahedral packing containers, can be produced. These are made in that the transverse narrow sealing zones are turned about 90° in relation to one another. Thus a continuous line of packaging containers of the desired tetrahedral shape is formed directly and no further forming work is therefore required.

Both these types of packing containers are provided with opening arrangements so as to facilitate the emptying out of the contents enclosed therein. Generally, the opening arrangement is produced in that some part of the packing container wall is demarcated by means of a separating line in the form of a weakening line or an indication line, along which the material is to be clipped or cut. In the tetrahedral type of packing container such an emptying opening is placed preferably at one of the corners of the packing container, whilst in the parallelepipedic package one of the folded-in corner lugs mentioned earlier serves after folding out as a pouring spout, its outer end being separable along a separating line.

The described placing of the pouring openings at the outer end of an integral part of the packing container forming the pouring spout makes possible a pouring out of contents in a well concentrated and oriented jet without any wastage or afterdrop occurring. Owing to the shape of the emptying opening and the shape of the package as well as because of the angle of inclination of the packing container during the emptying of the contents, difficulties may arise however under certain circumstances. These are due to the need of continuously having to replace the volume of contents emptied out by a corresponding volume of air. Thus the air must enter through the pouring opening at the same time as the emptying out of the contents takes place. This air flow directed against the flow of the contents, especially in the case of relatively narrow and long pouring spouts, causes the flow of contents to be stopped periodically by the air flowing in, and to be restarted when a certain quantity of air has entered. This gives rise to a jerky emptying of the contents, generally described as "gurgling", and renders difficult or impossible the emptying of the contents in a satisfactorily concentrated jet.

It has been attempted to solve the abovementioned problems in parallelepipedic packing containers of the type described by providing an air hole on the top of the packaging container which allows air to enter the topmost part of the package whilst the pouring out of the contents takes place. This type of packing container certainly eliminates the gurgling problem, but makes it necessary to provide each packing container with two openings which renders the manufacture of the packing container considerably more complicated and expensive. To provide two separate openings on each packing container is also a disadvantage from the consumer's point of view, since the opening of the packing container demands two separate actions, namely on the one hand the folding out, shaping and opening of the packing container part representing the pouring spout, and on the other hand the searching for and opening of the air inlet opening situated at the opposite end of the packing container top e.g. by means of the pointed end of a knife or by the tearing off of a strip covering the air hole, a so-called pull-tab.

It would be desirable therefore to provide a packing container of the non-returnable type with an emptying opening in the form of a pouring spout which does not give rise to the abovementioned problems or disadvantages.

It is an object of the present invention, therefore, to provide a packing container which is uncomplicated, simple to open and to pour out in a well concentrated and directed jet.

It is a further object of the present invention to provide a packing container of the non-returnable type with a pouring spout which permits during the pouring out of the contents the admission of such an amount of air into the packing container that the problem of gurgling is eliminated.

Finally, it is a further object of the present invention to provide a packing container which is simple to open and does not require several openings to be exposed separately, and which moreover is reclosable.

These and other objects have been achieved in accordance with the invention in that a packing container of the non-returnable type comprising a container body consisting of flexible packing laminate with an integral part forming a pouring spout whose outer end is separable, has been given the characteristic that the part forming the pouring spout comprises two separate ducts, namely an emptying duct and an air duct which both extend from the interior of the container to the outer end of the part representing the pouring spout.

Preferred embodiments of the packing container in accordance with the invention have been given the further characteristics which are evident from the subsidiary claims.

Two embodiments of the packing container in accordance with the invention will now be described in detail with special reference to the attached schematic drawings which only show the details necessary for an understanding of the invention.

Figure 2:
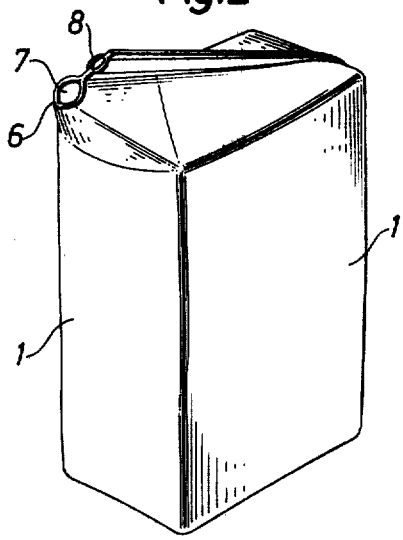
Figure 3:
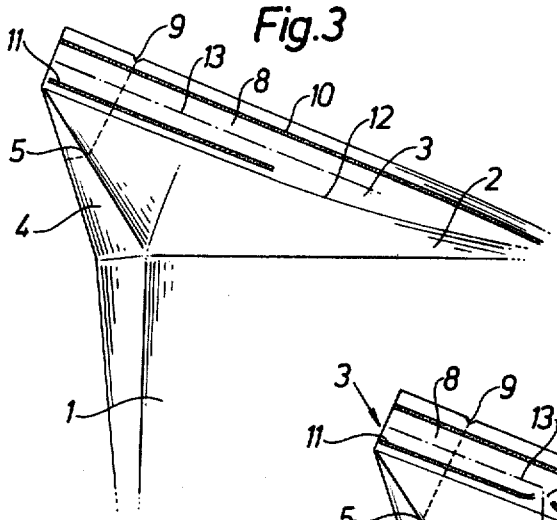
Figure 4:
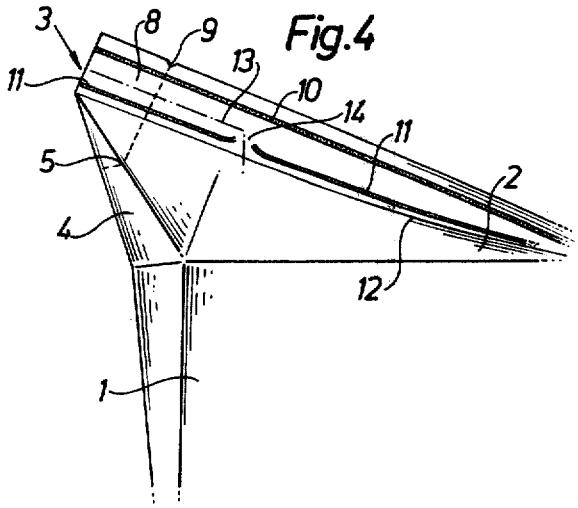

FIG. 1 shows in perspective a packing container in accordance with the invention, FIG. 2 shows the packing container in accordance with FIG. 1 in opened condition, FIG. 3 is a side view on a larger scale of a part of the packing container in accordance with a first embodiment of the invention after folding up of a corner lug serving as a pouring spout, but before the actual opening of the packing container, FIG. 4 corresponds to FIG. 3 but shows a second embodiment of the packing container in accordance with the invention.

The packing container shown in FIG. 1 comprises four substantially rectangular side walls 1 (only two of which are visible in the figure) and two also substantially rectangular end walls 2 (only one of which is visible in the figure). The packing container is manufactured from a flexible, inherently relatively stable, web-like laminate, formed into a tube which is flattened and sealed up at uniform intervals in transverse, narrow zones. After cutting, again in transverse direction, through the said zones, cushion-shaped packing containers are obtained which at their top and bottom ends have sealing fins, which in the subsequent conversion of the packing containers to substantially parallelepipedic shape end up at the top and bottom end of the packing containers where the said sealing fins, indicated by reference numeral 3, extend transversely across the respective end wall 2. In connection with the forming of the packing container, the sealing fins 3 are folded down to rest against the material surface to which they are connected.

In the forming process which is required in order to convert the substantially cushion-shaped packing containers into the parallelepipedic form shown, four substantially triangular, double-walled corner lugs 4 (of which only one is visible in the figure) are formed. The corner lugs 4 are folded about the straight wall edges along which they are connected to the parallelepipedic packing container proper and are fixed by means of heat sealing to the packing container wall. The lug 4 visible in FIG. 1, situated at one of the upper ends of the packing container serves as a pouring spout when the contents present in the packing container are to be emptied out. To this end the seal between the corner lug and the side wall of the packing container is broken and the corner lug is folded up to the position shown in FIG. 2, whereupon its outer end is separated or severed along a separating line 5 so that an emptying opening 6 is formed at the outer end of an emptying duct 7 formed by the folding up and shaping of the corner lug. In addition to the emptying duct 7 the corner lug 4 forming the pouring spout also comprises and air duct 8 which extends substantially parallel with the emptying duct, and whose outer end is exposed together with the emptying opening 6 when the outer corner of the corner lug is torn off. The air duct extends through a part of the fin 3 arranged at the upper end surface 2 of the packing container and ends up inside the packing container, as will be described in more detail in the following.

FIG. 3 shows from the side and on a larger scale part of a first embodiment of the packing container in accordance with the invention, namely the upper corner at which the corner lug 4 forming the emptying duct is situated. The corner lug 4 is shown in the position which it is in when, in preparation of the opening of the packing container, it has been detached from the side wall to which it is connected and has been folded up and moulded so as to form an emptying duct. The packing container has not yet been opened though, that is to say, the outer end of the corner lug demarcated by means of a separating line 5 has not yet been torn off. The figure makes evident how the sealing fin 3 situated at the upper end surface of the packing container extends over the corner lug 4 and crosses the separating line 5 which may be constituted either of a weakening line in the material or of a visual line indicating a suitable place for tearing or cutting. In cases where the separating line consists of a weakening line in the material, for instance, a perforating line penetrating the carrier layer or base layer of the material, its upper end situated in the sealing fin 3 may coincide with an indent 9 in the fin in order to facilitate the start of the tearing.

The sealing fin 3 consists of two material layers which are joined to one another along a sealing line 10 extending over the whole width of the packing container. This sealing line is relatively narrow and extends along the upper edge of the sealing fin 3, that is to say, the free edge of the sealing fin. A further sealing line 11 extends from the end of the sealing fin 3 situated at the corner lug 4 and in towards the centre of the packing container, crossing the separating line 5 and terminating at a distance from the far end of the sealing fin 3 in relation to the pouring spout. The sealing line 11 extends substantially parallel with the sealing line 10 as well as with the sealing fin. However, the sealing line 11 runs substantially along the base line 12 of the sealing fin 3, that is to say, at the opposite side of the sealing fin 3 in respect of the sealing line 10 so that a relatively wide, unsealed area of sealing fin 3 is obtained between the sealing lines 10 and 11. This area forms the air duct 8 which thus extends between the two packing material layers placed against each other which form the sealing fin 3, and is demarcated on the one hand by the sealing line 10, on the other hand by the sealing line 11. Since the sealing line 11 is appreciably shorter than the sealing fin 3, the air duct formed will end up inside the packing container in the vicinity of the centre of the sealing fin 3. The sealing line 11 typically has a length which amounts to approximately twice the length of the pouring spout 4, thus providing considerable space for the rear end of the air duct connected to the interior of the packing container.

The above description indicates that the packing container in accordance with the invention comprises a part forming the pouring spout which part contains two separate ducts, namely an emptying duct of a relatively large cross-section, and an air duct of smaller cross-section, both extending from the interior of the container to the outer end of the part 4 of the pouring spout. Whereas the emptying duct 7 widens immediately inside the emptying opening and passes over into the packing container proper, the air duct 8 in the fin 3 extends a certain distance into the packing container e.g. a third of the length of the sealing fin. As a result the air can flow without hindrance into the packing container via the air duct 8, when the packing container is inclined for pouring out the contents through the emptying opening 6, since the rear end of the air duct 8 will then project into the packing container above the free surface of the contents. This design of the pouring spout has been found to function well in practice and wholly eliminates the problem of the so-called gurgling mentioned in the introduction. The emptying opening can be made relatively small without any difficulty, so that on emptying out the contents a well concentrated and easily directed jet is formed.

The asymmetric sealing of the sealing fin which is a feature of the embodiment described above because of the sealing line terminating inside the package has the consequence that the stresses arising during the making of the packing container are concentrated on the end point of the sealing line instead of being distributed over the whole length of the fin as previously. This stress concentration is undesirable, since it increases the risk of ruptures and leakages resulting therefrom.

The continuous manufacture of packing containers of the aforementioned type takes place, as described earlier, by the conversion and division of a packing material tube filled with contents. The packing containers can be oriented in several different ways in relation to the tube, but in a method used more generally the packing containers are formed to lie horizontally in relation to the tube, that is to say, in such a manner that the said sealing fin containing the air duct is formed by the longitudinal sealing fin of the tube. The air duct here makes necessary an accurate register-holding, since the sealing line forming the duct must be placed correctly in each packing container.

The abovementioned difficulties are overcome in a second embodiment of the arrangement in accordance with the invention, which embodiment is described in the following with special reference to FIG. 4 which corresponds to FIG. 3 but shows a second, somewhat modified form of realization of the arrangement in accordance with the invention.

From FIG. 4, in which the same reference numerals are used as in the earlier figure, it is evident that the sealing line 11 in this embodiment, differently from what is the case in the embodiment described earlier, extends along the whole length of the sealing fin 3 and, like the sealing line 10, crosses the separating line 5. The sealing line 11 runs substantially along the base line 12 of the sealing fin 3, that is to say, on the opposite side of the sealing 3 in respect of the sealing line 10, so that a relatively wide unsealed area of the sealing fin 3 is obtained between the sealing lines 10 and 11. This area forms the air duct 8 which thus extends between the two packing material layers placed against each other which form the sealing fin 3, and is demarcated on the one hand by the sealing line 10, on the other hand by the sealing line 11. The air duct formed extends, therefore, over the whole width of the packing container and is provided with an air hole 14 which connects the duct with the inner space of the container body.

The discontinuity and consequently the air hole 14 is located preferably where the pouring spout passes over into the packing container proper, which location has been found to ensure that air can enter the packing container without any hindrance via the air duct 8 and the air hole 14 when the packing container is inclined so as to pour the contents from the emptying opening 6, since the air hole 14 will then end up above or in the vicinity of the free surface of the contents inside the packing container.

Owing to the sealing line 11 extending over the whole length of the sealing fin, that is to say, over the whole width of the packing containers, the problem of stress concentrations and the risk of splitting are also overcome, since the forming forces are now distributed over the whole length of the sealing line 11. The negligible stress concentration which it may be considered still arises owing to the discontinuity for the air hole 14 in the sealing line 11, is reduced according to a further preferred embodiment of the invention in that the sealing line 11 is curbed on either side of the discontinuity in the direction towards the air duct, so that any stress concentration initiating a splitting up is prevented.

A further reduction and distribution of stress concentrations at the discontinuity in the sealing line forming the air hole 14 can be obtained in accordance with the invention in that the portions of the sealing line 11 adjoining the discontinuance are of a lower sealing strength than the rest of the sealing line. The sealing strength preferably diminishes successively in the direction towards the discontinuity. This can be achieved by a reduced sealing temperature and/or reduced sealing pressure and ensures in practice that the stress, which endeavours to separate from each other the laminates joined together by means of the sealing line 11, is not concentrated at the end points of the sealing line but is absorbed and distributed over a greater length of the sealing line, which effectively reduces the risk of splitting.

Certain modifications of the embodiments of the packing container in accordance with the invention as described above are necessary in certain cases, e.g. owing to the stiffness and other properties of the material chosen for the manufacture of the packing container. When a relatively stiff packing material is used, the two material layers making up the sealing fin will tend to lie against each other also in the unsealed area between the two sealing lines 10 and 11, that is to say, in the area which is to form the air duct 8 and in the area where the air hole 14 is situated. In order to eliminate this problem and to ensure that the active part of the air duct 8 has a sufficiently large cross-sectional area it is appropriate to provide the two material layers forming the sealing fin 3 each with a crease line situated between the sealing lines 10 and 11, as indicated by means of a dash-dotted line 13 in FIGS. 3 and 4. The two crease lines 13 are produced before the flattening and sealing of the sealing fin 3 in that by means of a creasing tool traces are pressed into the material from its inside, that is to say, from the two layers of the packing material facing one another. The crease lines will thus be situated with the concave side facing towards the opposite material layer of the sealing fin, which ensures that the two material layers are somewhat apart from each other between the two sealing lines 10, 11 so that a free space is produced for the formation of the active part of the air duct extending between the pouring spout and the interior of the container. The crease lines 13 extend substantially parallel with the two sealing lines 10, 11 and halfway between them, and thereafter possible at an angle downwards towards the interior of the container, that is to say, they follow the active part of the air duct.

To ensure that the air duct 8 situated in the sealing fin 3 obtains the desired shape when the corner lug 4 is folded up and the packing container is opened, even after prolonged storage of the same it may be necessary in certain cases to form the air duct of a flexible element applied inside the sealing fin 3, which is adapted so as to separate the material layers of the fin from each other so that the air duct obtains the desired cross-sectional area and shape. Such a flexible element may consist, for example, of a double-walled material strip of a flexible plastic material of the type which even after a prolonged period endeavours to reassume its original shape (plastics with "memory", that is to say, cross-linked plastics are well-known to those versed in the art). It is also conceivable to insert a flexible tube or the like in the sealing fin.

The arrangement in accordance with the invention can also be made use of in packing containers of the type which have no sealing fin or which have a sealing fin not extending over the part forming the pouring spout. In such a case the air duct cannot, of course, be formed in the sealing fin, but a separate air duct must be formed instead, in that a duct-forming element is applied in the packing container in such a manner that it extends from a point inside the packing container out through the part forming the pouring spout. This element, for example, may be an elongated material strip which is connected to the inside of the material of the packing container along two sealing lines extending along the edges so that an air duct is formed between them. Thus the air duct is formed by the material strip together with the inside of the packing material. In this embodiment the air duct can, of course, also be produced by the application of a tube of a thin flexible plastic material inside the package in such a manner that on inclining the packing container for the purpose of pouring out the contents, it connects the space above the free liquid surface in the packing container to the surrounding atmosphere.

Since in the second embodiment the location of the air hole 14 in most cases is not critical for the function of the air duct, the location may be allowed to vary within relatively wide limits. Thus it is possible (with the intention of simplifying manufacture by no longer demanding register-holding) by repeated discontinuity in the sealing line 11 to provide a number of air holes at such mutual distance that one air hole will always be in a favourable location. Such a design of the sealing line 11 totally eliminates the need for register-holding, since, irrespectively of the position of the hole in relation to the pouring spout, the most favourably placed hole will always function in a satisfactory manner. As a result the packing container can be formed in any desired position along the packing material tube without the function of the air duct being affected, which is a great advantage since the costly and material-consuming register-holding can be saved.

Although the preferred embodiments of the arrangement in accordance with the invention have been described in connection with a well-known parallelepipedic packing container, the invention can, of course, also be applied, as is evident from what has been said above, to a variety of packing containers of different shape, e.g. packages or drum or tetrahedral shape and packages with or without suitably placed sealing fin. The essential point is only that the principle of the invention is retained, that is to say, that the packing containers comprises a part forming a pouring spout which has two separate ducts, namely an emptying duct and an air duct.

We claim:

1. A packing container of the non-returnable type, comprising:

a container body manufactured from a flexible laminated packing material;

a pouring spout which is integrally connected to said container body, and which pouring spout includes a severable end;

said pouring spout also including an emptying duct and a separate air duct, which ducts extend from the interior of said container body to said end of said pouring spout.

2. The packing container according to claim 1 wherein said pouring spout further includes a tear line along which said pouring spout may be torn to sever said end of said spout from said spout, said tear line intersecting said emptying duct and said air duct.

3. The packing container according to claim 1 wherein said pouring spout further includes a sealing fin formed from two layers of material positioned adjacent one another, a space between said layers of material defining said air duct.

4. The packing container according to claim 3 wherein said layers of material of said sealing fin are sealed together along first and second, spaced apart, sealing lines, a space between said sealing lines defining said air duct.

5. The packing container according to claim 4 wherein said first sealing line, which is more distant from said container body than said second sealing line, extends over the entire length of said sealing fin and said second sealing line extends from one end of said sealing fin, nearest said severable end of said pouring spout, over a portion of the length of said sealing fin.

6. The packing container according to claim 5 wherein said sealing fin includes a free edge and said first and second sealing lines are substantially parallel to one another and to said free edge.

7. The packing container according to claim 4 wherein an inner surface of each of said layers of material includes a crease line, arranged between said first and second sealing lines, said inner surface of each of said layers of material being concave in a region located adjacent said crease line and between said sealing lines.

8. The packing container according to claim 3 wherein said sealing fin includes means for maintaining a portion of each of said layers of material apart from one another to thereby preserve said space between said layers of material, which space defines said air duct.

9. The packing container according to claim 8 wherein said means includes a flexible element arranged within said sealing fin between said layers of material, which flexible element urges said layers of material apart from one another.

10. The packing container according to claim 1 wherein said air duct includes an elongate element arranged within the interior of said packing container, which elongate element is attached to an interior surface of said packing container, a space between said elongate element and said interior surface defining said air duct.

11. The packing container according to claim 1 wherein said air duct includes a flexible tube attached to an interior surface of said packing container.

12. The packing container according to claim 1 wherein said air duct extends over the entire width of said packing container, and said air duct includes an air hole which provides fluid communication between said air duct and the interior of said container body.

13. The packing container according to claim 3 wherein said two layers of material are sealed together along at least one sealing line, which at least one sealing line defines a demarcation between said air duct and the interior of said container body, and which at least one sealing line includes an air hole defined by a discontinuity in said at least one sealing line.

14. The packing container according to claim 13 wherein said at least one sealing line includes first and second portions arranged adjacent, and on opposite sides of, said discontinuity, each of said first and second portions having curved ends adjacent said discontinuity so that the end of each of said portions adjacent said discontinuity points toward said air duct.

15. The packing container according to claim 13 or 14 wherein said air duct includes an interior surface, which interior surface includes at least one crease line which extends across the entire length of said air duct, the extent of said crease line being equal to the extent of said sealing line and the extent of said discontinuity.

16. The packing container according to claim 11 wherein said sealing line includes a plurality of spaced-apart air holes defined by a plurality of spaced-apart discontinuities.

17. The packing container according to claim 16 wherein a sealing strength of the portions of said sealing line adjoining said discontinuities is less than a sealing strength of the portions of said sealing line spaced relatively more distantly from said discontinuities.

18. The packing container according to claim 16 wherein a sealing strength of said sealing line varies, said sealing strength diminishing in regions of said sealing line adjoining said discontinuities.

* * * * *